United States Patent [19]

Hayashi

[11] Patent Number: 4,515,116

[45] Date of Patent: May 7, 1985

[54] VALVE OPERATING SYSTEM OF INTERNAL COMBUSTION ENGINE

[75] Inventor: Yoshimasa Hayashi, Kamakura, Japan

[73] Assignee: Nissan Motor Company, Limited, Yokohama, Japan

[21] Appl. No.: 480,866

[22] Filed: Mar. 31, 1983

[30] Foreign Application Priority Data

Apr. 2, 1982 [JP] Japan ..... 57-55573

[51] Int. Cl.[3] ..... F01L 1/24

[52] U.S. Cl. ..... 123/90.43; 123/90.46; 123/90.36

[58] Field of Search ..... 123/90.36, 90.39, 90.43, 123/90.46

[56] References Cited

U.S. PATENT DOCUMENTS

| | | | |
|---|---|---|---|
| 1,699,659 | 1/1929 | Fagan | 123/90.39 |
| 2,572,968 | 3/1947 | Bachle | 123/90.36 |
| 2,905,160 | 9/1959 | Sampietro | 123/90.39 |
| 2,905,161 | 9/1959 | Latham | 123/90.36 |
| 3,096,749 | 7/1963 | Davidson | 123/90.39 |
| 3,150,648 | 9/1964 | Gropp | 123/90.39 |
| 4,104,996 | 8/1978 | Hosono et al. | 123/90.43 |
| 4,132,196 | 1/1979 | Wherry | 123/90.46 |

FOREIGN PATENT DOCUMENTS

| | | | |
|---|---|---|---|
| 55-51907 | 4/1980 | Japan . | |
| 953022 | 3/1964 | United Kingdom | 123/90.39 |

*Primary Examiner*—Ira S. Lazarus
*Assistant Examiner*—R. S. Bailey
*Attorney, Agent, or Firm*—Schwartz, Jeffery, Schwaab, Mack, Blumenthal & Koch

[57] ABSTRACT

A valve operating system of an internal combustion engine comprises a rocker arm swingable relative to a rocker arm shaft, and having a first end portion co-operative with an operating cam and a second end portion co-operative with a valve stem. The rocker arm is formed at its central part with a bearing section at which the rocker arm is swingably supported on the rocker arm shaft. The bearing section abuttingly contacts and extends along the outer peripheral surface of the rocker arm shaft. Additionally, the valve operating system is so arranged that engine lubricating oil is supplied under pressure between the rocker arm bearing section and the rocker arm shaft, thereby rendering the valve clearance zero in order to reduce noise generation from the valve operating system.

4 Claims, 4 Drawing Figures

VALVE OPERATING SYSTEM OF INTERNAL COMBUSTION ENGINE

BACKGROUND OF THE INVENTION

1. Field of the Invention

This invention relates to an improvement in a valve operating system of an internal combustion engine, and more particularly to a valve operating system which is adapted to reduce noise generated thereby.

2. Description of the Prior Art

In connection with a valve operating system using rocker arms of an internal combustion engine, a so-called valve clearance exists between a valve stem and an end section of the rocker arm, and therefore a forceful collision occurs between the valve stem and the the rocker arm, or between the rocker arm and a cam, thereby generating rocker noise which is offensive to the ear. In order to render the valve clearance zero, it has been proposed, for example, to use hydraulic valve lifters. However, this unavoidably complicates the configuration of the valve operating system while increasing the inertial mass of the parts of the valve operating system.

SUMMARY OF THE INVENTION

The valve operating system of the present invention comprises a rocker arm disposed in contact with and swingable about a rocker arm shaft. The rocker arm has a first end portion co-operative with an operating cam, and a second end portion co-operative with a valve stem. The rocker arm is formed at its central part with a generally semicylindrical bearing section at which the rocker arm is swingably supported on the rocker arm shaft. The bearing section contacts and extends along the outer peripheral surface of the rocker arm shaft. Additionally, the valve operating system is provided with a device for supplying engine lubricating oil under pressure between the rocker arm bearing section and the rocker arm shaft.

Accordingly, no valve clearance is formed during engine operation. This effectively prevents noise generation from the valve operating system, thereby achieving total noise reduction without using complicated mechanisms such as hydraulic valve lifters and without an increase in inertial mass of parts thereof.

BRIEF DESCRIPTION OF THE DRAWINGS

The features and advantages of the valve operating system according to the present invention will be more clearly appreciated from the following description taken in conjunction with the accompanying drawings in which like reference numerals designate corresponding elements, and in which.

DETAILED DESCRIPTION OF THE INVENTION

Figure 1:
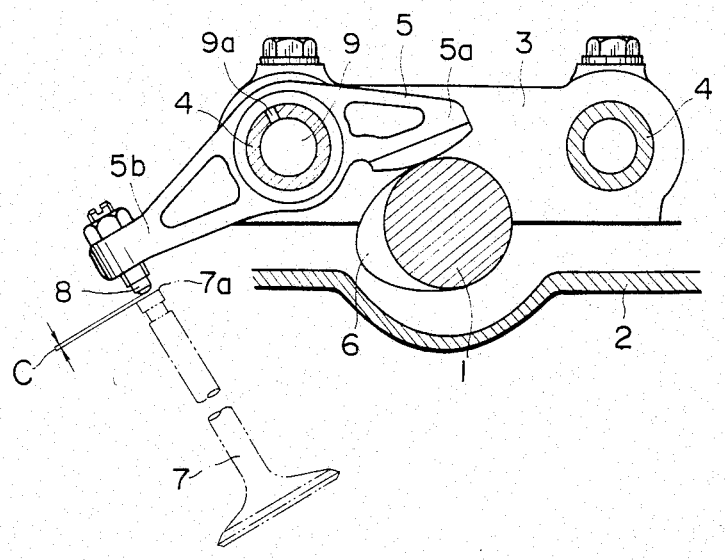
FIG.1 (PRIOR ART)
FIG. 1 is a vertical sectional view of a conventional valve operating system.

Referring to FIG. 1, an example of a conventional valve operating system for an internal combustion engine will be described along with its major shortcomings. The engine is of the OHC (overhead camshaft) type in which a camshaft 1 is disposed over a cylinder head 2. As shown, a rocker arm 5 is swingably supported on a rocker arm shaft 4 which fixedly supported on the cylinder head 2 through a bracket 3 serving also as a bearing for the camshaft 1. One end portion 5*a* of the rocker arm 5 is in contact with a overhead cam 6 formed integral with the camshaft 1, and the other end section 5*b* is connectable with the end portion 7*a* of a valve stem 7 of an intake or exhaust valve through an adjustment screw 8 for adjusting a valve clearance C, so that the lift of the cam 6 is transmitted to the intake or exhaust valve. Additionally, an oil passage 9 is usually formed inside rocker arm shaft 4 and filled with engine lubricating oil. The engine lubricating oil is supplied through an oil hole 9*a* into between the rocker arm shaft 4 and the rocker arm 5 to lubricate them.

However, with such a valve operating system, due to the above-mentioned valve clearance, a forceful collision occurs between the rocker arm 5 and the valve stem end 7*a*, and between the rocker arm 5 and the cam 6, thereby generating rocker noise offensive to the ear. In order to prevent the generation of such rocker noise, a so-called zero lash mechanism for maintaining the valve clearance C at zero has been proposed in which hydraulic valve lifters or the like are used. However, this zero lash mechanism complicates the configuration of the valve operating system and contributes to a cost increase, accompanied by an inertial weight increase which is disadvantageous for the valve operating system.

Figure 2:
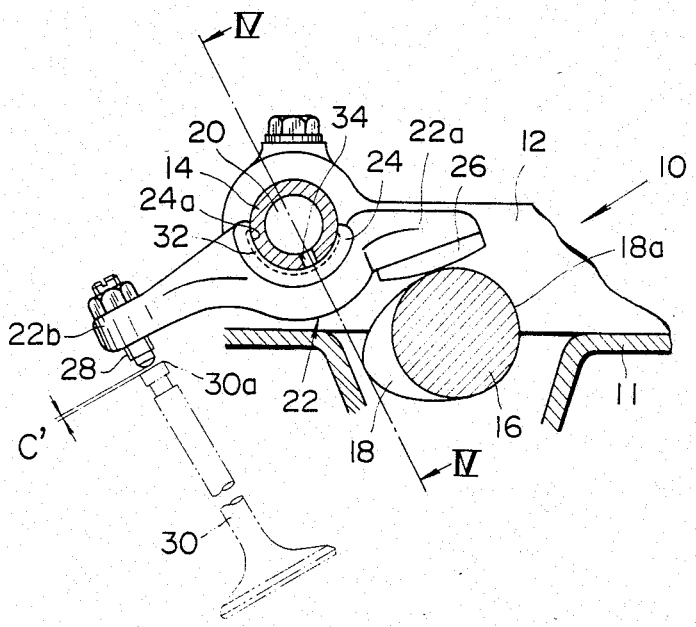
FIG. 2 is a vertical sectional view of an embodiment of a valve operating system in accordance with the present invention.
Figure 3:
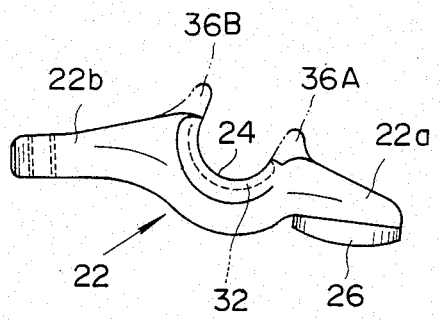
FIG. 3 is a front view of a rocker arm which forms part of the valve operating system of FIG. 2.
Figure 4:
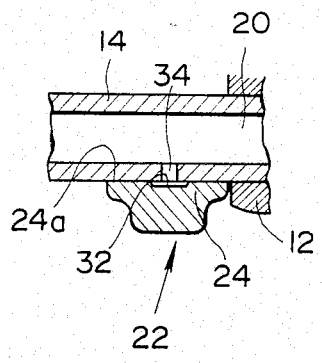
FIG. 4 is a sectional view taken in the direction of the arrows in FIG. 2 substantially along the line IV—IV.

In view of the above description of the conventional valve operating system, reference is now made to FIGS. 2 to 4, wherein a preferred embodiment of the valve operating system of the present invention is designated by the reference numeral 10. In this embodiment, the valve operating system 10 is incorporated with an automotive internal combustion engine of the OHC (overhead camshaft) type. A bracket 12 is fixedly mounted on a cylinder head 11 of the engine and securely supports a rocker arm shaft 14, serving also as a bearing for a cam shaft 16 which is integrally formed with overhead cams 18. The rocker arm shaft 14 is formed hollow and thereinside with an oil passage 20 through which engine lubricating oil flows.

A rocker arm 22 generally has an arcuate shape and is formed at its central part with a bearing section 24 which slidably fits on and slidably contacts the outer peripheral surface of the rocker arm shaft 14, so that the rocker arm 22 is swingably supported on the rocker arm shaft 14. The rocker arm 22 is further formed at one end portion 22*a* thereof with a tip section 26 which contacts the cam 18, and provided at the other end portion 22*b* thereof with an adjustment screw 28 for adjusting the valve clearance C′ defined between the tip of the adjustment screw 28 and the extreme end 30*a* of a valve stem 30 of an intake or exhaust valve.

As shown, the rocker arm bearing section 24 is generally semicylindrical and formed with a semicylindrical surface 24*a* which is in sliding contact with the cylindrical outer peripheral surface of the rocker arm shaft 14. Additionally, the rocker arm bearing section 24 is formed on the semicylindrical surface 24*a* with an oil groove 32 which is generally semicircular in shape and extends along the cylindrical outer peripheral surface of the rocker arm shaft 14. The groove 32 communicates with the oil passage 20 of the rocker arm shaft 14 through an oil hole 34 formed through the wall of the rocker arm shaft 14, so that the groove 32 is supplied with engine lubricating oil. It will be understood that the oil hole 34 is formed opposite or facing to the groove 32 so that the space of the oil hole 34 merges into the space of the groove 32. Additionally, the oil hole 34 is so located that the oil passage 20 of the rocker arm shaft 14 always communicates through the oil hole 34 with the groove 32 throughout the range in which the rocker arm 22 swingably moves during the operation of the engine with the valve operating system. The rocker arm 22 is pushed against the side face of the bracket 12 by means of a coil spring (not shown) fitted on the rocker arm shaft 14, thereby properly locating the rocker arm 22 in the axial direction of the rocker arm shaft 14.

The manner of operation of the thusly arranged valve operating system will be discussed hereinafter.

In an initial state shown in FIG. 2 in which the engine is halted and accordingly no oil pressure is applied between the rocker arm shaft 14 and the rocker arm bearing section 24, a predetermined amount (for example, about 0.15–0.30 mm) of valve clearance C′ is maintained between the tip of the adjustment screw 28 and the extreme end 30*a* of the valve stem 30.

During engine operation, engine lubricating oil from an oil pump (not shown) is fed under pressure into the groove 32 of the rocker arm bearing section 34 through the oil passage 20 and the oil hole 34, so that oil pressure is applied between the rocker arm shaft 14 and the rocker arm bearing section 24. Accordingly, the rocker arm 22 is pushed downwardly in the drawing, thereby making the valve clearance C′ zero. More specifically, when the tip section 26 of the rocker arm 22 is in contact with the base circle section 18*a* of the cam 18, the rocker arm bearing section 24 is urged downward under the action of the oil pressure applied between the rocker arm shaft 14 and the rocker arm bearing section 24 so as to be slightly separated from the outer surface of the rocker arm shaft 14. As a result, the tip section of the adjustment screw 28 is brought into contact with the extreme end 30*a* of the valve stem 30. When the lift of the cam 18 starts from the above state, the rocker arm bearing section 24, which has been slightly separate from the rocker arm shaft 14, is brought into contact with the rocker arm shaft 14, and thereafter the rocker arm 22 swings about the rocker arm shaft 14, thereby pushing the valve stem 30 to open the intake or exhaust valve. Therefore, no forceful collision occurs between the adjustment screw 28 and the valve stem extreme end 30*a*, thus effectively preventing the generation of noise due to collisions therebetween. Additionally, since an oil film is formed between the relatively broad contacting surfaces of the rocker arm shaft 14 and the rocker arm bearing section 24, generation of collision noise is also prevented even when the rocker arm bearing section 24 is brought into contact with the rocker arm shaft 14.

As shown in FIG. 3, it is preferable that the rocker arm bearing section 24 is formed at its opposite end portions with extended or projected sections 36A, 36B which are formed opposite to and parallel with each other. With this arrangement, the support of rocker arm 22 relative to the rocker arm shaft 14 can be further improved. Moreover, in locating the rocker arm 22 in the axial direction of the rocker arm shaft 14, the contacting area of the rocker arm shaft 22 with the side face of the bracket 12 and the coil spring is increased, thereby further effectively reducing the play of the rocker arm 22.

While the principle of the present invention has been shown and described as being applied only to the valve operating system of an OHC type engine, it will be understood that the invention is not limited thereto and therefore may be applied to the valve operating system of an OHV (overhead valve) type engine in which a push rod is interposed between a cam and a rocker arm.

As will be appreciated from the above, according to the valve operating system of the present invention, so-called rocker noise generated due to collision of the valve stems etc. during cam lift can be remarkedly reduced, thereby achieving total noise reduction of the internal combustion engine. It is to be noted that such noise reduction can be attained without using a complicated mechanism such as a hydraulic valve lifter while preventing an increase in inertial mass.

What is claimed is:

1. A valve operating system of an internal combustion engine, comprising:

a rocker arm disposed in abutting contact with and swingable relative to a rocker arm shaft, said rocker arm having a first end portion co-operative with an operating cam, and a second end portion co-operative with a valve stem, a generally semicylindrical bearing section formed on said rocker arm at the central part thereof and at which said rocker arm is swingably supported on said rocker arm shaft, said bearing section abuttingly contacting and extending along the outer peripheral surface of said rocker arm shaft; and means for supplying engine lubricating oil under pressure between said bearing section and said rocker arm shaft and forcing said rocker arm away from said rocker arm shaft during engine operation to effectively maintain zero valve clearance, said oil supplying means including means defining a closed end groove on a surface of said rocker arm bearing section which surface is contactable with the outer peripheral surface of said rocker arm shaft, said groove being formed with an arcuate shape and extending along the outer peripheral surface of said rocker arm shaft, means defining an oil passage in said rocker arm shaft, said oil passage being filled with engine lubricating oil supplied under pressure, and means defining a hole in said rocker arm shaft to establish fluid communication between said oil passage and said groove.

2. A valve operating system as claimed in claim 1, wherein said hole of said rocker arm shaft is so located as to continually establish the communication between said oil passage of said rocker arm shaft and said groove of said rocker arm bearing section during engine operation.

3. A valve operating system as claimed in claim 2, further comprising first and second projecting sections which are respectively formed at the opposite extreme end portions of said rocker arm bearing section, said first and second projecting sections being located opposite to and parallel with each other so that said rocker arm shaft is interposed between said first and second projecting sections.

4. A valve operating system as claimed in claim 1, further comprising means for causing the pressure of said engine lubricating oil to apply onto said bearing section in a direction to reduce a valve clearance.

* * * * *